US005556020A

United States Patent [19]

Hou

[11] Patent Number: 5,556,020

[45] Date of Patent: Sep. 17, 1996

[54] POWER STAPLE GUN

[76] Inventor: Chang F. Hou, No. 52, Alley 17, Lane 20, Chung-Shan Road, Tai-ping Hsiang, Taichung Hsien, Taiwan

[21] Appl. No.: 505,001

[22] Filed: Jul. 21, 1995

[51] Int. Cl.[6] ..... B25C 1/04

[52] U.S. Cl. ..... 227/109

[58] Field of Search ..... 227/109, 119, 227/120; 173/2 D

[56] References Cited

U.S. PATENT DOCUMENTS

| | | | |
|---|---|---|---|
| 3,720,364 | 3/1973 | Maestri | 227/109 |
| 4,375,867 | 3/1983 | Novak et al. | 227/109 |
| 4,524,896 | 6/1985 | Morrell, Jr. | 227/109 |
| 4,815,647 | 3/1989 | Chou | 227/109 |
| 5,477,995 | 12/1995 | Dooley et al. | 227/109 |

*Primary Examiner*—Scott A. Smith

*Attorney, Agent, or Firm*—Morton J. Rosenberg; David I. Klein

[57] ABSTRACT

A power staple gun including a gun body having a staple nozzle at one end and a coupling frame at an opposite end, a magazine connected between the staple nozzle and the coupling frame to hold staples, and a follower member for pushing the staples toward the staple nozzle, wherein the magazine defines different pairs of staple grooves for loading staples of different lengths, having a staple loading port at one side for loading staples into one pair of staple grooves, the staple loading port having a straight top side, a straight bottom side being an elongated through hole, a straight lateral side and a stepped lateral side bilaterally connected between the straight top side and the straight bottom side, the stepped lateral side having steps corresponding to the pairs of staple grooves and being marked with marks for indexing the loading of different sizes of staples.

4 Claims, 6 Drawing Sheets

POWER STAPLE GUN

BACKGROUND OF THE INVENTION

The present invention relates to power staple guns, and relates more particularly to such a power staple gun which has pairs of staple grooves for loading staples of different lengths, and marks for indexing the loading of staples of different lengths.

Various power staple guns are well known, and intensively used for driving staples into workpieces. FIG. 1 shows a power staple gun according to the prior art, which comprises a gun body 16 having a staple nozzle 15 at one end, a coupling frame 17 at an opposite end, a magazine 10 connected between the staple nozzle 15 and the coupling frame 17 and defining two parallel staple grooves 14 for loading staples 12, and a follower member 11 for pushing staples 12 toward the nail nozzle 15. The magazine 10 further has a rectangular staple loading port 13 at one side for loading staples 12 in the staple grooves 14. When the follower member 11 is pulled backwards toward the coupling frame 17, staples 12 can then be inserted through the staple loading port 13 into the staple grooves 14. When staples 12 are loaded, the follower member 11 is released from hand to move the staples 12 forwards. If long staples are used, they can be loaded in the magazine 10 from the top side. This structure of power staple gun is still not satisfactory in function. One drawback of this structure of power staple gun is its limited application. Because the power staple gun has only one pair of staple grooves, only limited sizes of staples can be used. Another drawback of this structure power staple gun is that there is no indexing means to show staples of different specifications. When staples of different sizes are alternatively used, wrong staples may be loaded and driven into workpieces. Furthermore, when buying staples, the user shall have to check if the staples fit the power staple gun.

SUMMARY OF THE INVENTION

It is one object of the present invention to provide a power staple gun which is practical in use for driving nails of different lengths into workpieces. It is another object of the present invention to provide a power staple gun which has means to guide the loading of staples of different lengths into different staple grooves.

According to the present invention, the power staple gun comprises a gun body having a staple nozzle at one end and a coupling frame at an opposite end, a magazine connected between the staple nozzle and the coupling frame to hold staples, and a follower member for pushing the staples toward the staple nozzle, wherein the magazine defines different pairs of staple grooves for loading staples of different lengths, having a staple loading port at one side for loading staples into one pair of staple grooves, the staple loading port having a straight top side, a straight bottom side being an elongated through hole, a straight lateral side and a stepped lateral side bilaterally connected between the straight top side and the straight bottom side, the stepped lateral side having steps corresponding to the pairs of staple grooves and being marked with marks for indexing the loading of different sizes of staples.

DETAILED DESCRIPTION OF THE PREFERRED EMBODIMENTS

Figure 1:
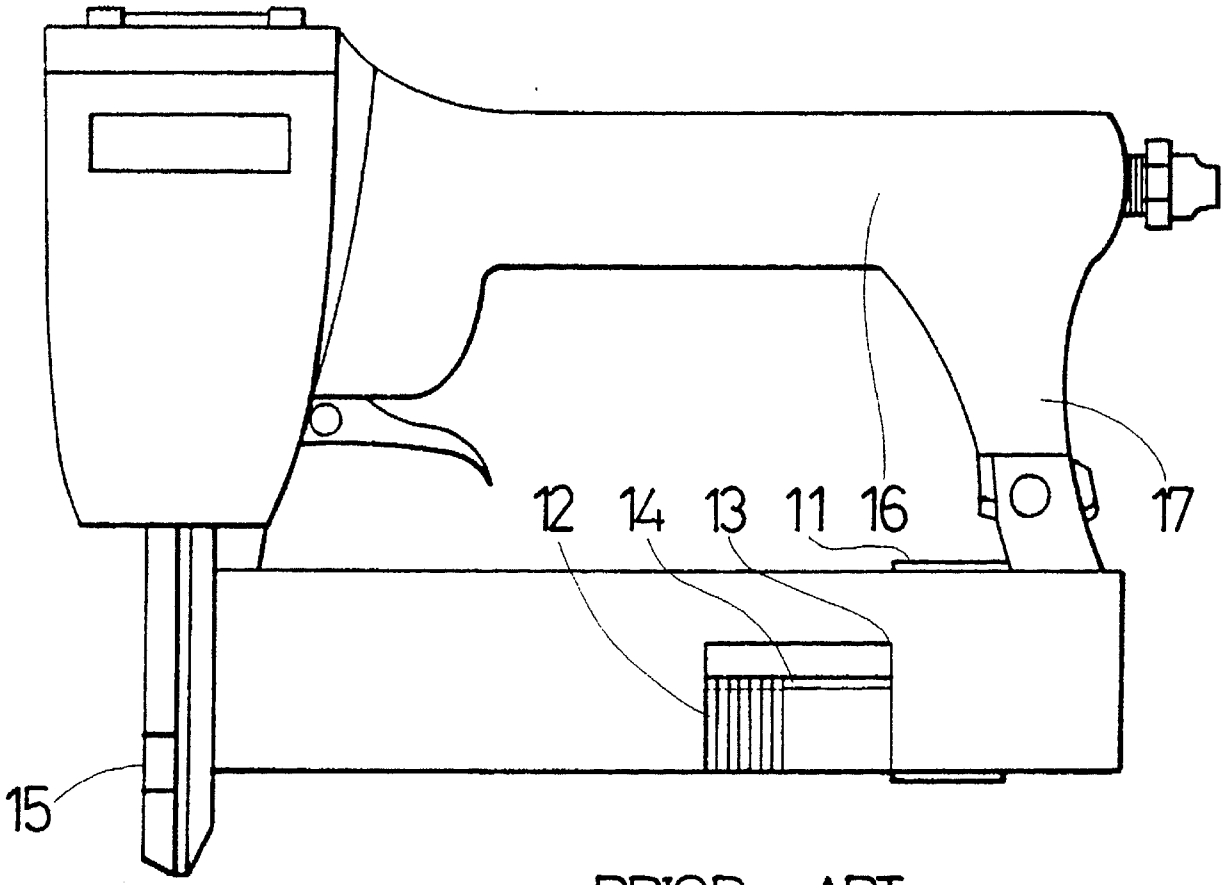
PRIOR ART FIG. 1
FIG. 1 shows a power staple gun according to the prior art.
Figure 2:
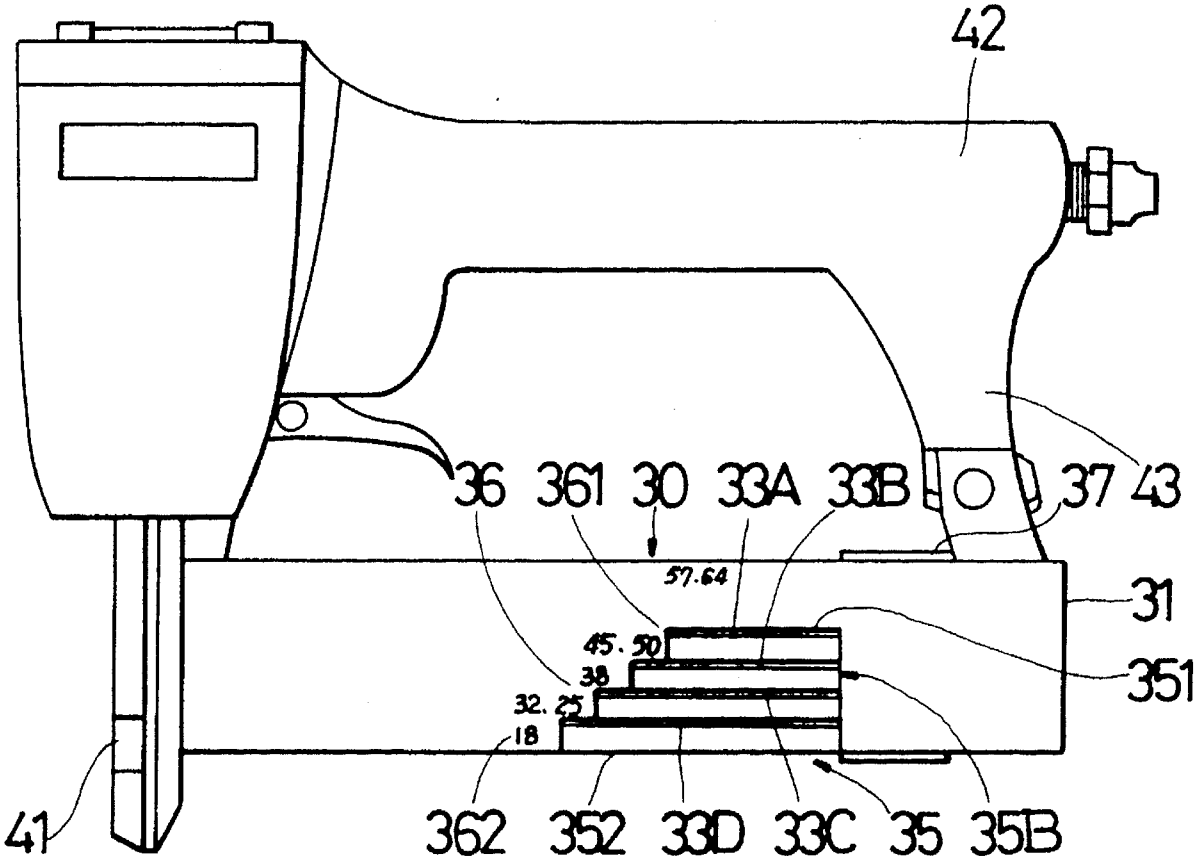
FIG. 2 is a front view of a power staple gun according to the present invention.
Figure 5:
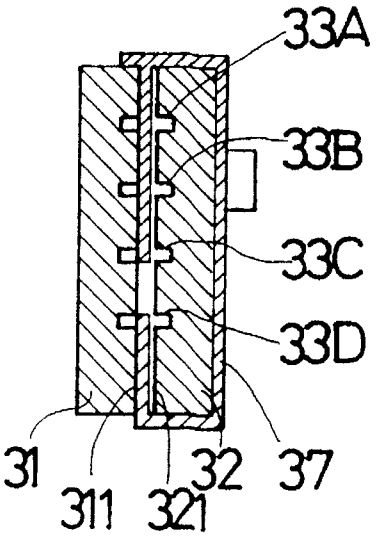
FIG. 5 is a sectional view taken along line V—V of FIG. 4.
Figure 3:
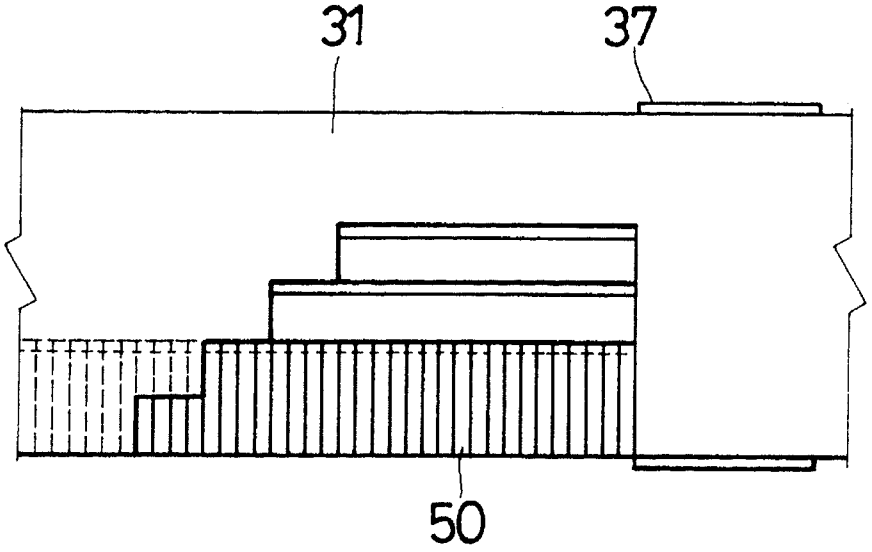
FIG. 3 is a partial view in section of the magazine shown in FIG. 2, showing staples loaded.
Figure 4:
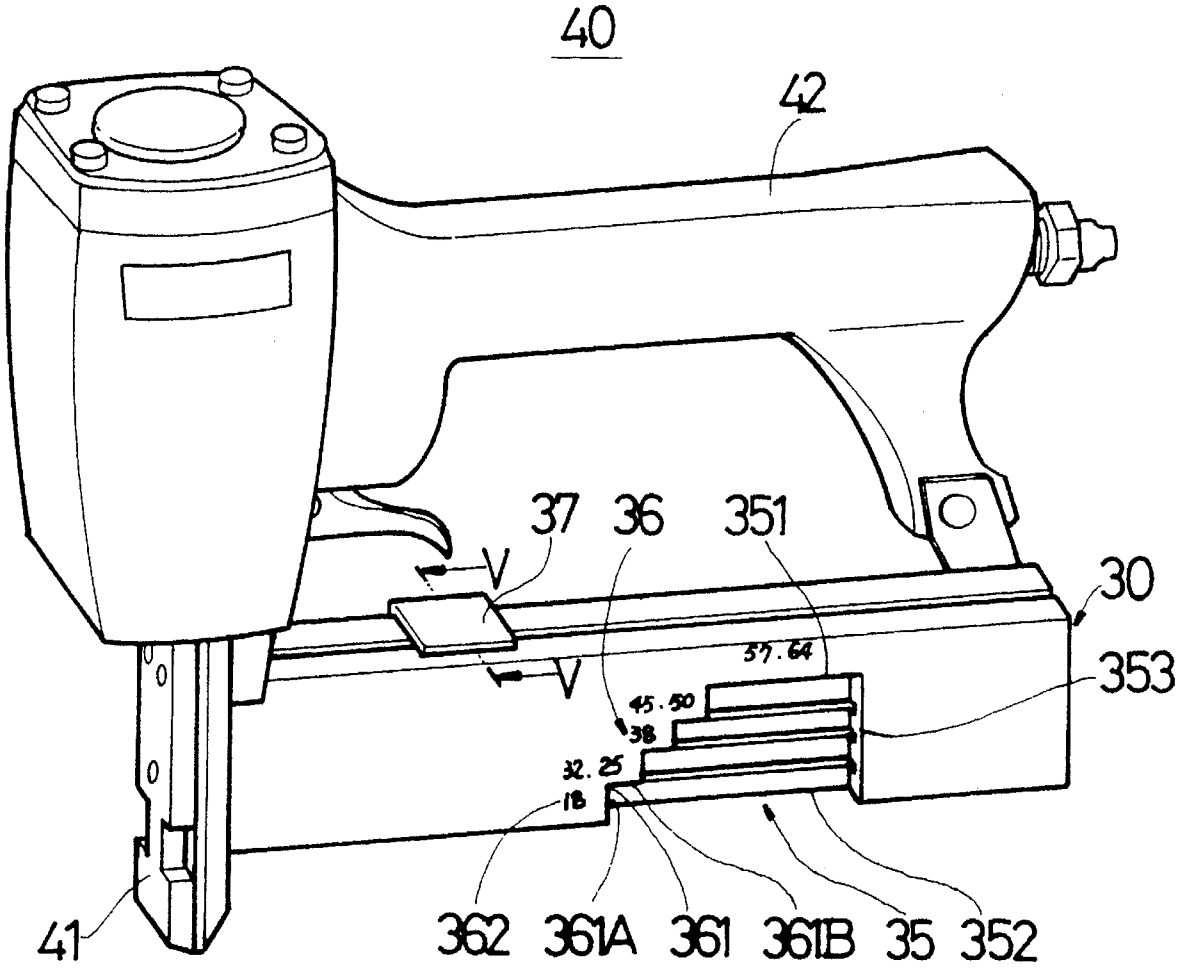
FIG. 4 is similar to FIG. 2 but showing staples loaded.

Referring to FIGS. from 2 to 5, a power staple gun is shown comprised of a gun body 42, a staple nozzle 41 downwardly extended from the gun body 42 at one end, a coupling frame 43 downwardly extended from the gun body 42 at an opposite end and substantially disposed in parallel to the staple nozzle 41, a magazine 30 connected between the staple nozzle 41 and the coupling frame 43, and a staple driving member 37. The magazine 30 comprises two rectangular guide boards 31 and 32 longitudinally disposed at two opposite sides, at least two pairs of parallel staple grooves 33A, 33B, 33C, and 33D on the inner walls 311 and 321 of the guide boards 31 and 32 for receiving staples 50 of different lengths. One guide board 32 has a staple loading port 35 at a suitable location. The staple loading port 35 comprises a straight top side 351, a straight bottom side 352, a straight lateral side 353 disposed closer to the coupling frame 43 and connected between the straight top side 351 and the straight bottom side 352, and a stepped lateral side 36 disposed closer to the staple nozzle 41 and connected between the straight top side 351 and the straight bottom side 352 opposite to the straight lateral side 353, wherein the straight bottom side 352 is a rectangular through hole. The stepped lateral side 36 comprises a series of steps 361, each step 361 comprised of a horizontal portion 361A and a vertical portion 361B connected at right angles. The horizontal portions 361A of the stepped lateral side 36 are respectively aligned with the staple grooves 33A, 33B, 33C, and 33D. Marks 362 (for example, 45 or 50 mm, 38 mm, 32 or 25 mm, and 18 mm) are respectively marked on the magazine 30 adjacent to the steps 361 for indexing the sizes of the corresponding staple grooves. The follower member 37 for moving the staples 50 in between the guide boards 31 and 32 toward the staple nozzle 41. Through the staple loading port 35, the selected staples 50 can be inserted into the corresponding staple grooves 33A, 33B, 33C, or 33D, for example, the short staples can be loaded in the staple grooves 33D, the long staples can be loaded in the staple grooves 33A. Through the indexing of the marks 362, staples 50 can be quickly and accurately loaded into the correct staple grooves. Furthermore, the length of the straight top side 351 is shorter than that of the straight bottom side 352. Therefore, the staple loading port 35 has a narrower top and a broader bottom.

Figure 6:
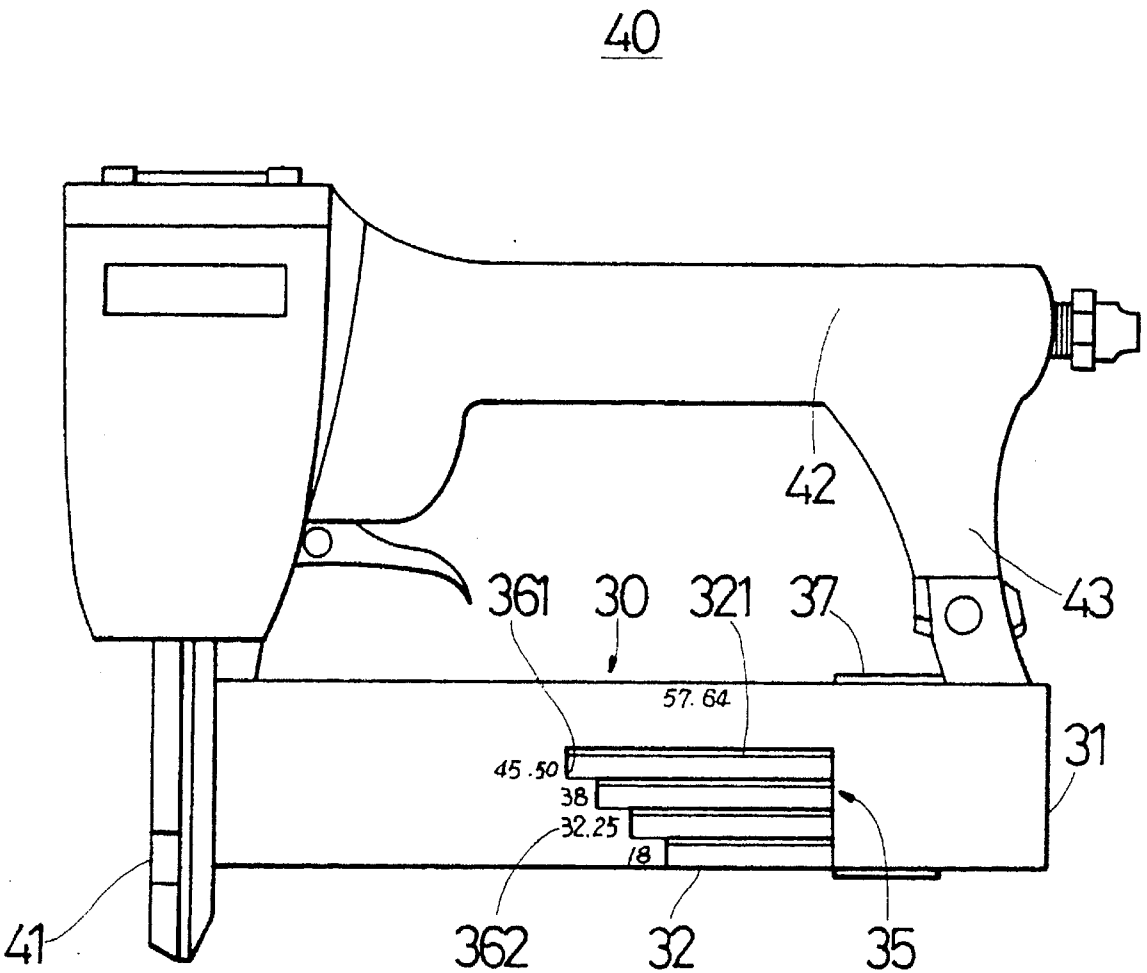
FIG. 6 is a front view of an alternate form of the present invention.

FIG. 6 shows an alternate form of the staple loading port 35. According to this alternate form, the length of the straight top side 351 is longer than that of the straight bottom side 352, therefore the staple loading port 35 has a broader top and a narrower bottom.

Figure 7:
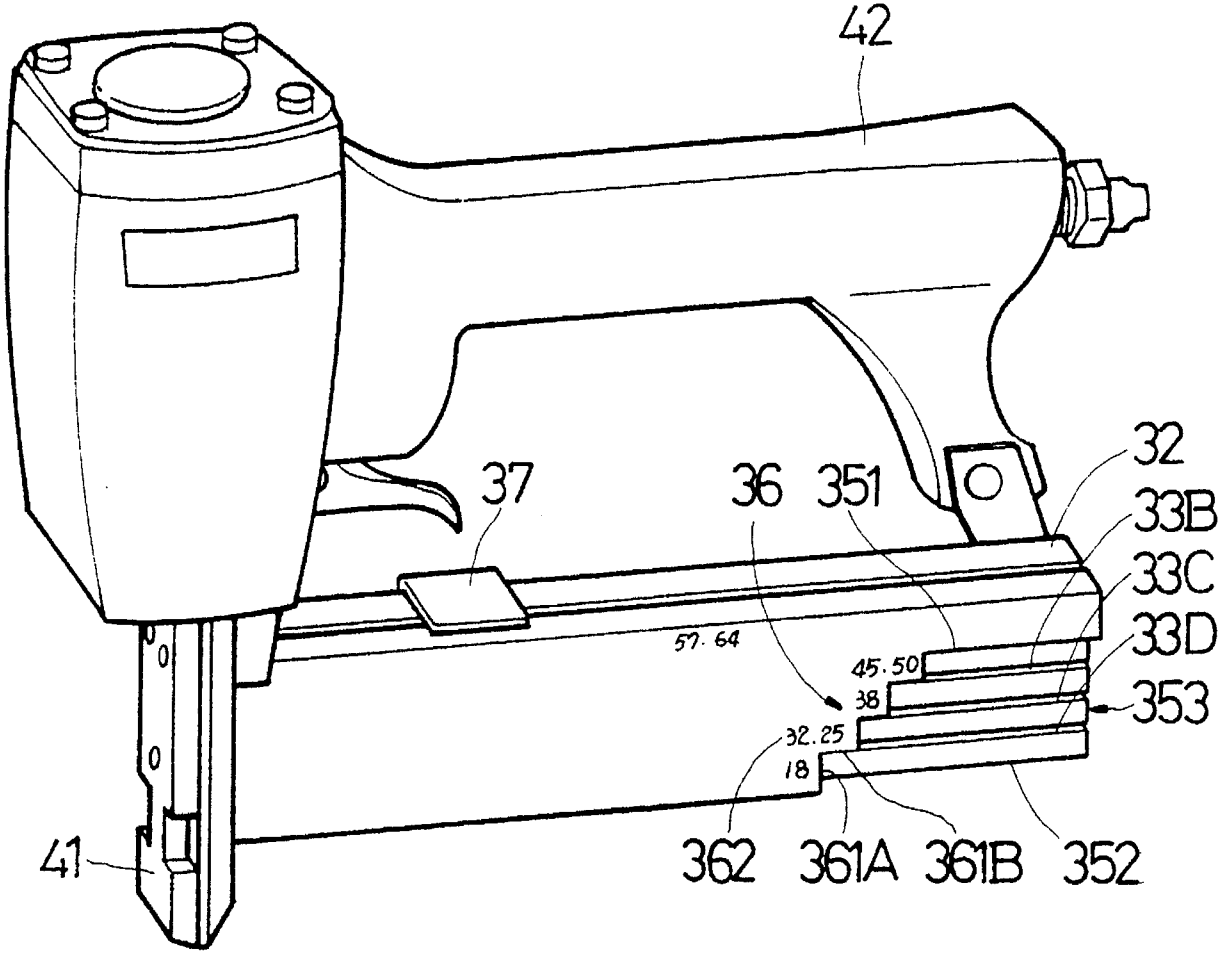
FIG. 7 is a front view of another alternate form of the present invention.

FIG. 7 shows another alternate form of the staple loading port 35, in which the stepped lateral side 36 is a through hole.

It is to be understood that the drawings are designed for purposes of illustration only, and are not intended as a definition of the limits and scope of the invention disclosed.

I claim:

1. A power staple gun comprising:

a gun body;

a staple nozzle downwardly extended from said gun body at one end;

a coupling frame downwardly extended from said gun body at an opposite end and substantially disposed in parallel to said staple nozzle;

a magazine connected between said staple nozzle and said coupling frame to hold staples, said magazine comprising two rectangular guide boards longitudinally disposed at two opposite sides, at least two pairs of parallel staple grooves within said guide boards for receiving staples of different lengths, and a staple loading port on one guide board, said staple loading port comprising a straight top side, a straight bottom side being an elongated through hole, a straight lateral side disposed closer to said coupling frame and connected between said straight top side and said straight bottom side, and a stepped lateral side disposed closer to said staple nozzle and connected between said straight top side and said straight bottom side opposite to said straight lateral side, said stepped lateral side comprising a series of steps and a plurality of marks at one side by each step to show different lengths corresponding to said staple grooves, each step comprised of a horizontal portion and a vertical portion connected at right angles, the horizontal portions of said stepped lateral side being respectively aligned with said staple grooves; and a follower member disposed in said magazine at one end for pushing staples toward said staple nozzle.

2. The power staple gun of claim 1 wherein the straight top side of said staple loading port is shorter than that of said straight bottom side.

3. The power staple gun of claim 1 wherein the straight top side of said staple loading port is longer than that of said straight bottom side.

4. The power staple gun of claim 1 wherein said stepped lateral side is a stepped through hole.

* * * * *